US007370761B2

(12) United States Patent
Andersen et al.

(10) Patent No.: US 7,370,761 B2
(45) **Date of Patent: *May 13, 2008**

(54) INNOVATIVE SHIPPING PACKAGE

(75) Inventors: Dale Andersen, Fridley, MN (US); Peter N. Fox, Burnsville, MN (US)

(73) Assignee: Delkor Systems, Inc., Fridley, MN (US)

( * ) Notice: Subject to any disclaimer, the term of this patent is extended or adjusted under 35 U.S.C. 154(b) by 331 days.

This patent is subject to a terminal disclaimer.

(21) Appl. No.: 10/668,646

(22) Filed: Sep. 23, 2003

(65) Prior Publication Data

US 2004/0129594 A1 Jul. 8, 2004

Related U.S. Application Data

(63) Continuation-in-part of application No. 10/388,100, filed on Mar. 13, 2003, now abandoned, which is a continuation of application No. 09/902,971, filed on Jul. 11, 2001, now Pat. No. 6,588,594.

(51) Int. Cl.
*B65D 75/00* (2006.01)

(52) U.S. Cl. ..... 206/497; 206/432; 206/499; 206/526

(58) Field of Classification Search ..... 53/398, 53/399, 441, 442, 449; 206/144, 192, 427, 206/432, 460, 497, 499, 526, 813
See application file for complete search history.

(56) References Cited

U.S. PATENT DOCUMENTS 3,118,537 A * 1/1964 Copping ..... 206/153
3,302,784 A * 2/1967 Copping ..... 206/153
3,331,503 A 7/1967 Brown ..... 206/139
3,347,365 A 10/1967 Funkhouser ..... 206/139
3,385,429 A * 5/1968 Becker et al. ..... 206/139
3,675,767 A 7/1972 Taylor ..... 206/162
3,883,000 A 5/1975 Gibbs ..... 206/432
4,036,362 A 7/1977 Ullman ..... 206/432
4,050,579 A 9/1977 Gorski et al. ..... 206/460
4,062,448 A * 12/1977 Meighan ..... 206/432
4,077,516 A 3/1978 Duerr ..... 206/497
4,079,566 A * 3/1978 Stoecklin ..... 53/399
4,119,202 A 10/1978 Roth ..... 206/432
4,304,332 A 12/1981 Danti ..... 206/432

(Continued)

*Primary Examiner*—Mickey Yu
*Assistant Examiner*—Jerrold Johnson
(74) *Attorney, Agent, or Firm*—Vidas, Arrett, Steinkraus

(57) ABSTRACT

A container package assembly comprises a first support member and a second support member, each of which have a front side, a back side, a right side and a left side. The support members being arranged along a common plane wherein one of the sides of the first support member is immediately adjacent to one of the sides of the second support member. Each of the support members further comprise at least one wall defining at least a portion of at least one of the front side, back side, right side and left side of the first support member and second support member. Containers are positioned on the support surface of the first support member and the second support member. A top pad is positioned on top of the containers and extends over at least a portion of each of the containers. The support members, the containers and the top pad comprise an assembly which is at least partially encapsulated by a film.

25 Claims, 16 Drawing Sheets

U.S. PATENT DOCUMENTS 4,427,108 A 1/1984 Coles et al. ..... 206/44
4,625,864 A * 12/1986 Nigrelli ..... 206/427
4,690,281 A * 9/1987 Berthet ..... 206/597
4,919,265 A 4/1990 Lems et al. ..... 206/432
4,919,270 A 4/1990 Govang et al. ..... 206/597
4,998,619 A 3/1991 Sowa et al. ..... 206/392
5,370,233 A 12/1994 Schutz et al. ..... 206/597
5,647,191 A * 7/1997 Villemure ..... 53/447
5,887,717 A 3/1999 Anderson et al. ..... 206/460
5,895,540 A * 4/1999 David et al. ..... 156/226
6,152,305 A * 11/2000 Green ..... 206/764
6,588,594 B2 7/2003 Andersen et al. ..... D32/22

* cited by examiner

INNOVATIVE SHIPPING PACKAGE

CROSS-REFERENCE TO RELATED APPLICATIONS

This Application is a continuation-in-part (CIP) of 10/388,100, filed Mar. 13, 2003 now abandoned, which is a continuation of U.S. patent application Ser. No. 09/902,971, which was filed Jul. 11, 2001 and issued as U.S. Pat. No. 6,588,594 the entire contents of both of which are incorporated herein by reference.

BACKGROUND OF THE INVENTION

Devices for packing and shipping products and/or containers of products are known. Such devices are available in a wide variety of shapes, sizes and styles. Often a package is designed to contain a number of different containers, such as several containers of a product, in a single package for delivery from one location to another, such as from a manufacturer to a wholesaler or retail seller. Sometimes the shipping package is also used to display the product once the shipping package is opened at the retail seller.

In many cases, the package used to ship containers of product from the manufacturer to the retailer is of such type that the containers need to be removed from the package prior to displaying the containers in the retail environment. The need to remove the containers form the package is often time and labor intensive. Additionally, a separate display package may be required to display the package. The display package may be a secondary package inside the shipping package, often resulting in higher costs for the containers.

Where a package, and the containers it holds, is suitable for transitioning directly from shipping to retail display, the size of the package can be an important factor. Shelf space at the retail environment is very valuable and the retail package must be of proper size to conform to the limited space allocated for display of the package. The need for smaller display packages is increasing as products compete for increasingly limited shelf space.

The trend toward decreasing the size of the display package poses a problem for the combination shipping package which transforms into a display package. A shipping package must conform to the dynamics required to safely transport product from the manufacturer to the retail environment. The size of the shipping package is important as this package must meet common length and width requirements to be effectively palletized. If the size of the shipping package is too small, it will be become increasingly difficult to palletize and to interlock the layers of shipping packages in the pallet. This will effect the strength and durability of the pallet of product in distribution.

A smaller shipper also effects the requirements of the secondary packaging machinery at the manufacturing plant for the product. Most secondary packaging machines are designed for speed based on the number of shipping packages produced per minute. If the size of the display package causes the size and container count of the shipper to decrease, it may require a new secondary packaging machine to meet the speed requirements of the container line.

A smaller shipper is generally more costly that a larger shipper. If the size of the display package causes the shipper to decrease in both size and container count, it may result in a more cost per container for the combination shipping package and display package.

In addition to a trend toward smaller display packages, there is also a need for a display package to offer full view and access of the container to the consumer. Many display packages which also serve as shipping packages restrict the full view and access of the containers due to use of sides and lids of material, such as cardboard. In order to provide greater view and access to the containers, the cardboard material of such shipping packages must be heavily modified such as by cutting, tearing or otherwise removing one or more flaps, lids or other portions of the package. Such modification of shipping packages is inconvenient and often results in a display device which is aesthetically displeasing and which displays the containers in an undesirable manner. Such cutting of the cardboard to prepare the display may also result in damaged containers that are accidentally cut when the shipping package is modified to become a display package.

A combination shipping package which transitions to a display package usually offers a cost savings by elimination of a secondary display package and a secondary packaging line specific for a display package.

There remains a need for a cost effective low-bulk package which is capable of shipping a plurality of containers and transitions to a plurality of smaller display packages without a need for any cutting or tearing of the cardboard or other fairly rigid material of the package, and provides full consumer view and access to the containers, yet also meets the strength, durability, palletizing, and general industry standards for shipping packages of like containers to market.

Without limiting the scope of the invention, a brief summary of various embodiments of the invention is set forth below. Additional details of the summarized embodiments of the invention and/or additional embodiments of the invention may be found in the Detailed Description of the Invention below.

A brief abstract of the technical disclosure in the specification is provided as well for the purposes of complying with 37 C.F.R. 1.72.

BRIEF SUMMARY OF THE INVENTION

In one embodiment, the invention is directed to a container package assembly which includes a plurality of trays for supporting containers thereon, a top pad which is placed over the containers and at least one layer of encapsulating film which at least partially covers the combination top pad, containers and trays. The package may be used for shipping and, optionally, for retail display.

In at least one embodiment of the invention, the container package assembly comprises two or more trays which are positioned horizontally adjacent to one another. A plurality of containers is disposed on each tray and a top pad extends atop the containers over at least a portion of each of the trays. The trays, containers and top pad are at least partially encapsulated by a polymeric packaging film such as shrink-wrap, stretch-wrap, plastic or other type of thin pliable membrane. The top pad provides stability to the individual containers positioned on the trays during distribution of the shipping package as well as maintaining stability of the entire package by structurally linking the two independent trays.

The container package assemblies of the present invention desirably are sufficiently stable and strong enough to cope with the rigors of shipping as well as being of a size and bulk which allows the package assemblies to be placed in a retail setting without interfering with the consumer's ability to view and access the containers contained therein.

The container package assemblies have sufficient strength and dimensional characteristics to form interlocking layers of packages in a pallet and may be transitioned to a plurality of package assemblies which are sized to be placed in the limited shelf space of the retail setting.

Typically, the trays comprise a fairly rigid horizontal support surface. Desirably, the trays may have one or more vertical sides or walls to help retain the containers on the horizontal support surface. These side walls function to retain the containers on the horizontal support surfaces during the packaging process, during distribution, and during the transfer of the display package to the retail shelf. The walls may be of uniform height, may be tapered, or may have other configurations.

The inventive container package assembly may include one or more vertical levels of trays and containers. Where multiple vertical levels of trays are utilized, a single top pad may be placed atop the top layer of containers. It is also within the scope of the invention for a top pad to be placed between each layer of containers and the bottom surface of a vertically adjacent tray.

The top pad, in accordance with the invention, typically has a surface area equal to or less than the area of the tray positioned there under.

Some embodiments of the invention include encapsulating film which encapsulates less than the entire assembly of trays, containers and top pad. In some embodiments the film may have different light transmitting properties. Such as for example the film may be opaque, translucent and/or transparent.

The invention is also directed to a method for packaging a plurality of containers comprising the steps of providing a first support member and a second support member adjacent the first support member, the first and second support members having a plurality of containers disposed thereon, placing a top pad on top of the containers, the top pad extending over at least a portion of each of the containers and at least partially encapsulating the support members, the containers and the top pad with a film. Typically, the support members will have three sidewalls and an open side.

In at least one embodiment the assembly comprises: a pair of support members, a plurality of containers positioned thereon and a top pad positioned on the containers. The entire assembly is at least partially encapsulated within a removable film. Each of the support members has a front side, a back side, a right side and a left side. The support members are arranged along a common plane wherein one of the sides of the first support member is immediately adjacent to one of the sides of the second support member. Each support member further comprises at least one wall substantially perpendicular to the respective support surface and at least partially defines one of the sides of the respective support member. A plurality of containers is positioned on the support surface of each support member. A top pad extends over at least a portion of each of the containers and is positioned thereon.

In some embodiments a wall height of at least a portion of the at least one wall of the first support member and second support member tapers from a first height to a second height, wherein the second height is less than the first height.

In some embodiments a wall height of the at least a portion of the at least one wall of the first support member and the second support member defines a substantially arcuate taper from the first height to the second height.

In some embodiments a wall height of the at least a portion of the at least one wall of the first support member and the second support member defines a substantially linear taper from the first height to the second height.

In some embodiments the support members are arranged so that the right side of the first support member is immediately adjacent to the left side of the second support member.

In some embodiments the support members are arranged so that the right side of the first support member is immediately adjacent to the right side of the second support member.

In some embodiments the support members are arranged so that the front side of the first support member is immediately adjacent to the front side of the second support member.

In some embodiments the support members are arranged so that the front side of the first support member is immediately adjacent to the back side of the second support member.

In some embodiments the support members are arranged so that the back side of the first support member is immediately adjacent to the back side of the second support member.

In some embodiments a given support member comprises two walls opposite one another, for example the right side of the first support member comprises a right wall and the left side of the first support member comprises a left wall.

In at least one embodiment the wall height of at least a portion of the right wall and the left wall tapers from a first height to a second height, wherein the second height is less than the first height. In some embodiments the front side of a given support member comprises a front wall, and where the member includes a tapered right and left wall the wall height of the front wall is less than about the first height. In some embodiments the wall height of the front wall is less than about the second height. In some embodiments the back side of one or more support member comprises a back wall. In some embodiments the wall height of the back wall is at least as high as the wall height of the front wall.

In at least one embodiment a wall of the first support member is held immediately adjacent to a wall of the second support member by at least one adhesive. In some embodiments the adhesive is may be a permanent or temporary adhesive, such as a removable adhesive, time release adhesive, biodegradable adhesive and/or any combination thereof.

In at least one embodiment the top pad further comprises one or more top pad sides, and at least one top pad wall which at least partially define at least one of the sides. The at least one wall is substantially perpendicular to a pad surface and extends to the pad wall height in a direction substantially toward a wall of one or more of the support members.

In some embodiments at least one pad wall defines at least a portion of a front pad side and at least a portion of a back pad side of the top pad.

In some embodiments at least one pad wall defines at least a portion of a left pad side and at least a portion of a right pad side of the top pad.

In some embodiments at least one pad wall of the top pad defines at least a portion of the front pad side, at least a portion of the back pad side, at least a portion of the right pad side and/or at least a portion of the left pad side.

In some embodiments the height of a pad wall of the top pad is tapered along at least a portion of the pad wall length. In some embodiments the pad wall height is substantially uniform and continuous along the pad wall length.

In at least one embodiment at least one pad wall of the top pad comprises at least one visible surface, the visible surface having at least one readily visible indicia thereon.

Further aspects of the invention will become apparent form the detailed description which follows.

BRIEF DESCRIPTION OF THE SEVERAL VIEWS OF THE DRAWINGS

A detailed description of the invention is hereafter described with specific reference being made to the following drawings.

DETAILED DESCRIPTION OF THE INVENTION

Figure 1:
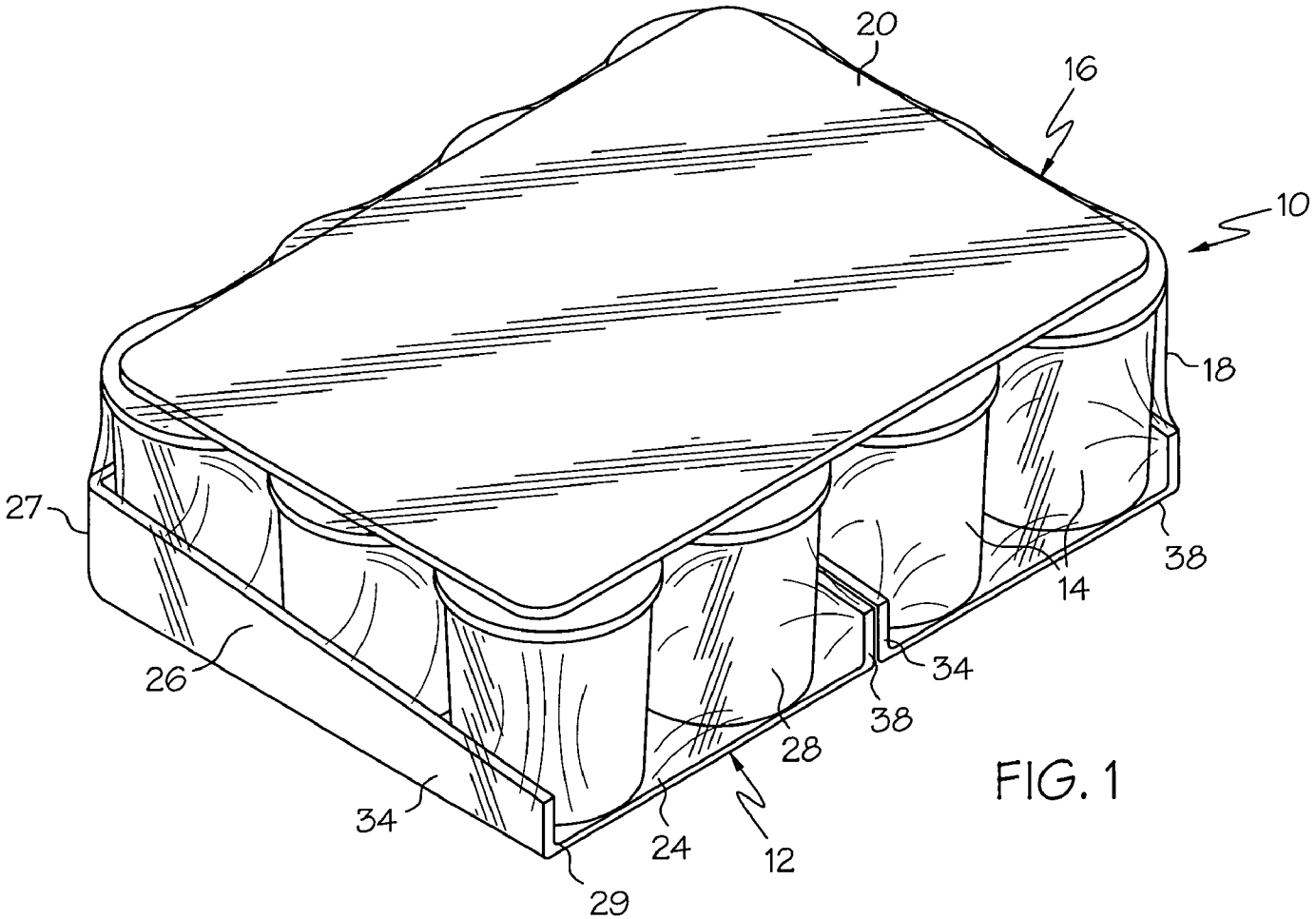
FIG. 1 is a perspective view of an embodiment of the invention.

While this invention may be embodied in many different forms, there are described in detail herein specific embodiments of the invention. This description is an exemplification of the principles of the invention and is not intended to limit the invention to the particular embodiments illustrated.

For the purposes of this disclosure, unless otherwise indicated, identical reference numerals used in different figures refer to the same component.

An embodiment of the inventive container package assembly is shown generally at 10 in FIG. 1. In the embodiment of FIG. 1, the container package assembly 10, comprises a pair of support members or trays 12. Each tray 12 includes three side walls 26 and an open side. The trays 12 may be constructed of any material suitable for shipping and displaying containers 14. For example, the trays may be constructed from cardboard (corrugated or otherwise), press-board, chipboard, SBS board, wood, one or more paper product derivative, plastic, metal or other materials. Preferably, the trays are constructed from a light weight material that may be easily and inexpensively recycled or disposed of. Trays 12 support a plurality of containers 14 as shown.

The containers 14 may be arranged on the trays 12 in any manner desired. For improved stability and strength, the containers are preferably arranged in a uniform pattern of rows and or columns. Such an arrangement has the added benefit of providing ready viewability and ease of access when the trays 12 of containers 14 are placed in a retail environment.

Once the containers 14 are placed on the trays 12 in a desired arrangement, the top pad 16 is placed on top of the containers 14. The top pad 16 may have a horizontal surface 20 having an area which extends at least partially over each of the trays 12. The horizontal surface 20 of the top pad 16 may be greater than, equal to, or less than the area of the combined trays 12 positioned there under. Typically, the top pad will have an area slightly less than the combined area of the trays over which the top pad extends. Once the top pad 16 is in place on top of the containers 14, the combined assembly of trays 12, containers 14, and top pad 16 may be in-whole or in-part encapsulated by a film 18.

The top pad 16 forms a supporting linkage between the trays 12. The top pad 16 may further act as a cutting surface once the package 10 is received. The film 18 may be cut and opened, through application of a knife or other cutting means. The presence of the top pad 16 prevents the cutting means from contacting and damaging the containers 14 positioned there under. After the film 18 is cut and the package 10 opened, the top pad 16 may then be removed from the containers 14, and the two independent trays 12 may be used as shelf ready displays.

Figure 5:
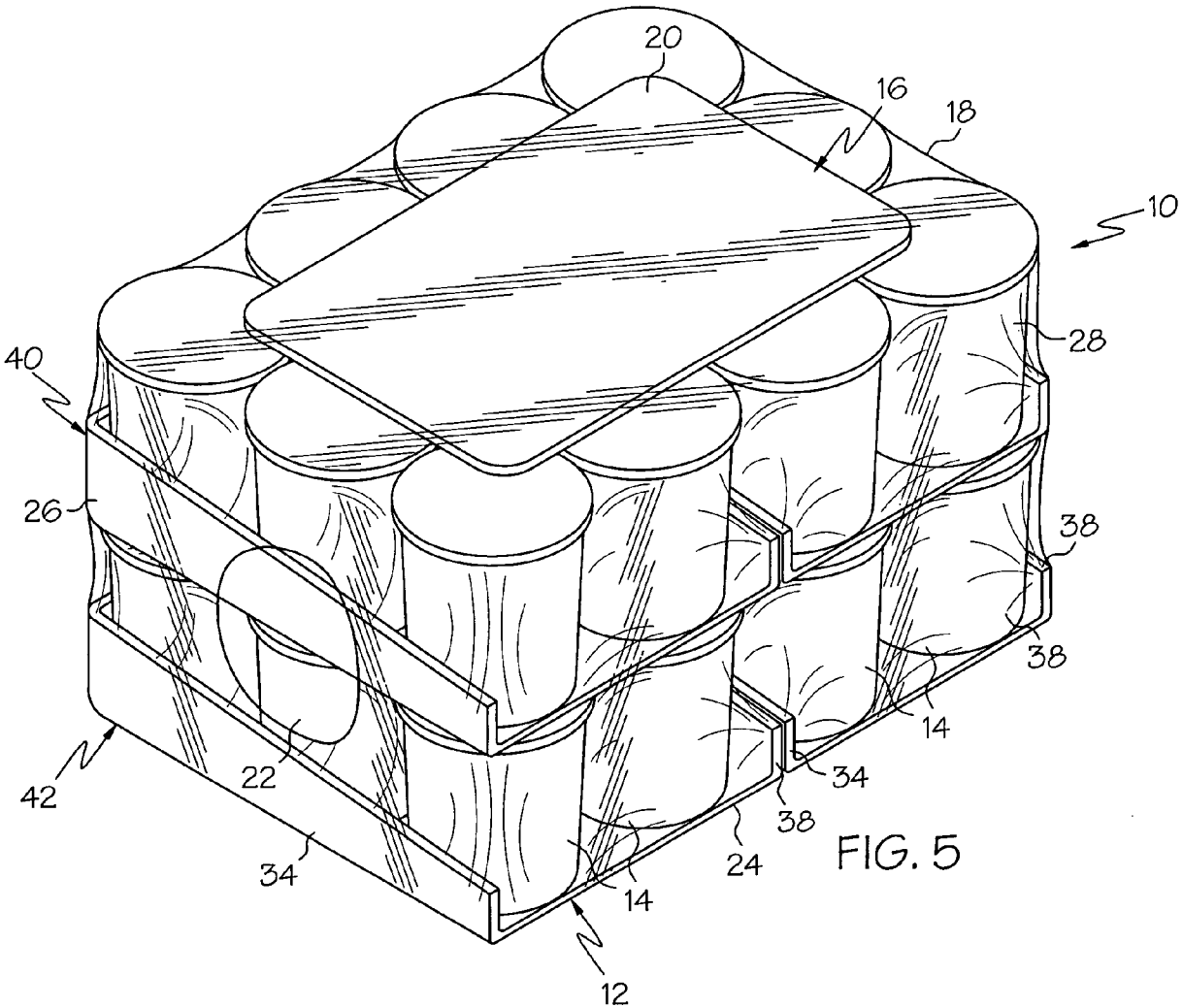
FIG. 5 is a perspective view of an embodiment of the invention.

The film 18 may be any type of retaining film or material. For example the film 18 may be shrink-wrap, stretch wrap, plastic sheeting or netting, or any other type of retaining material. The film 18 may encapsulate the entire combination of trays 12, containers 14, and top pad 16, such as is shown the embodiment of FIG. 1, or alternatively, the film may have one or more openings 22 therethrough, such as is shown in FIG. 5. The film 18 may be transparent, translucent or opaque; however, a transparent film may be more preferable for retail display purposes as it is desirable to allow wholesale or retail consumers to be able to view the containers 14 even when the film 18 is in place.

Figure 2:
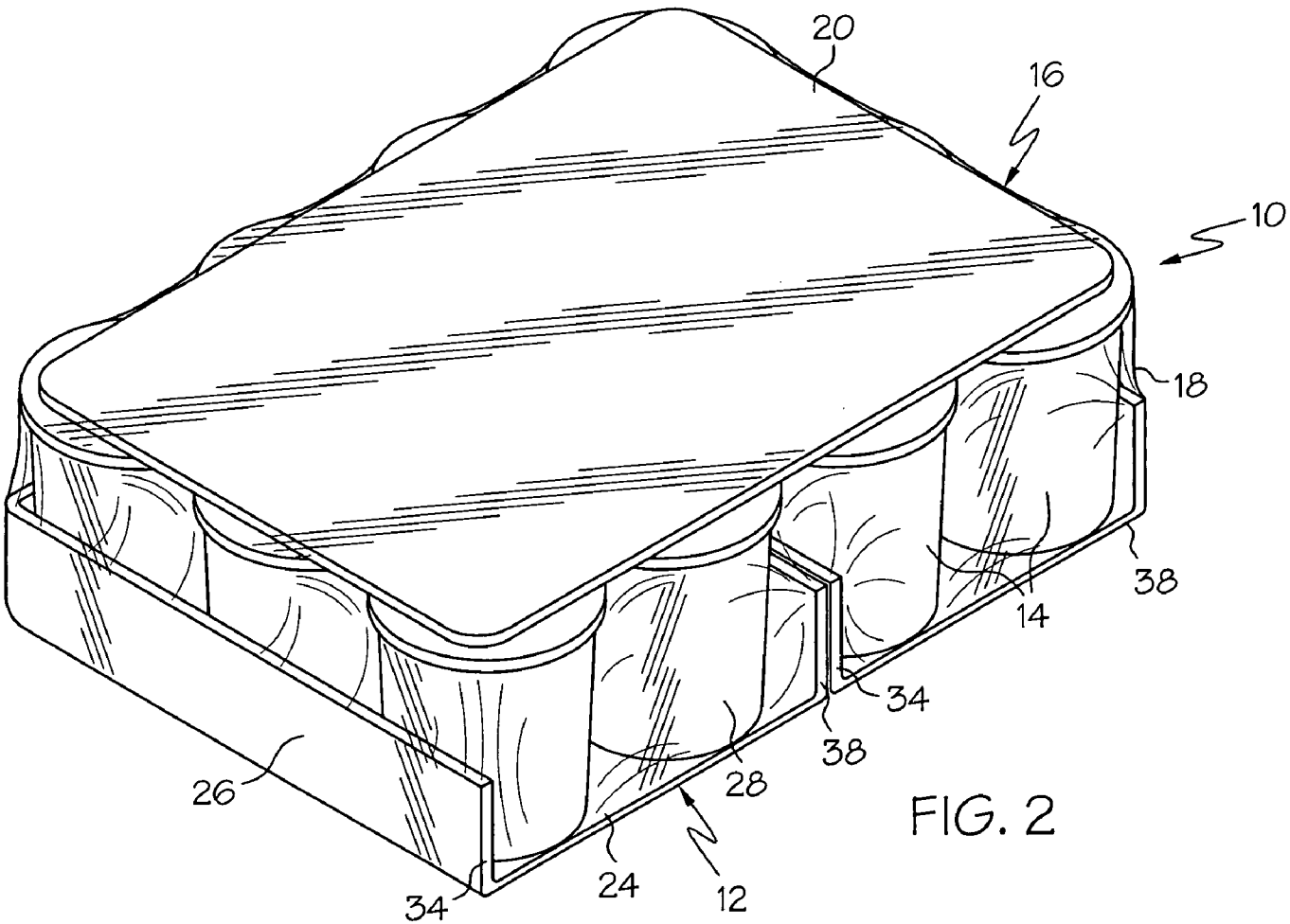
FIG. 2 is a perspective view of an embodiment of the invention.
Figure 4:
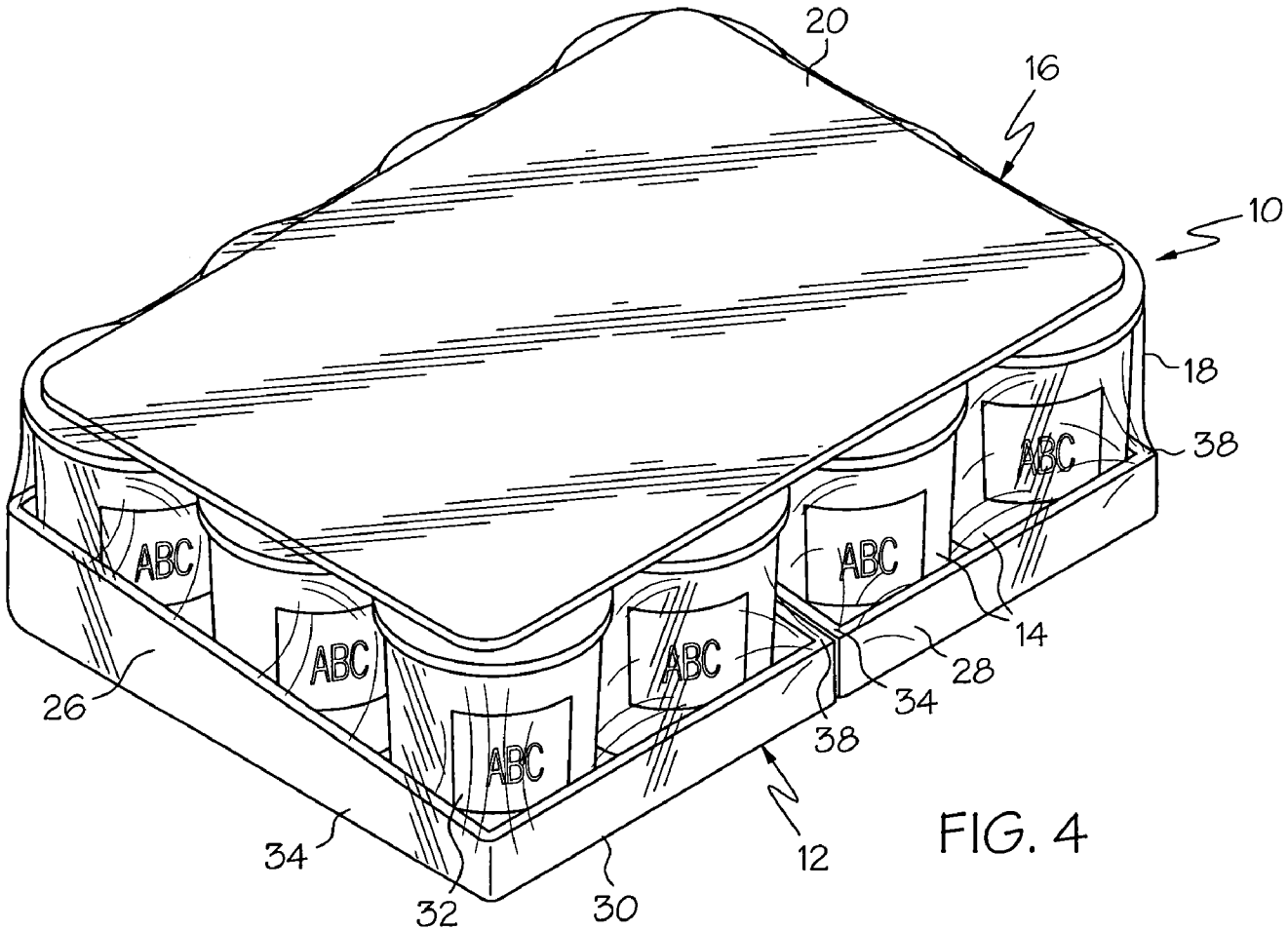
FIG. 4 is a perspective view of an embodiment of the invention.

As shown in FIGS. 1, 4 and 5, each tray 12 may comprise a horizontal support surface 24 upon which the containers 12 are placed along with three side walls. A three-walled tray provides improved stability while ensuring that the front 28 of the containers 14 is fully exposed for retail viewing. Two of the side walls 26, such as right side wall 34 and left side wall 38 optionally taper from the back 27 of the tray to the front 29 the tray. The extent of the taper may vary greatly. In accordance with the invention, the side walls may also be of uniform height as shown in FIG. 2.

Figure 3:
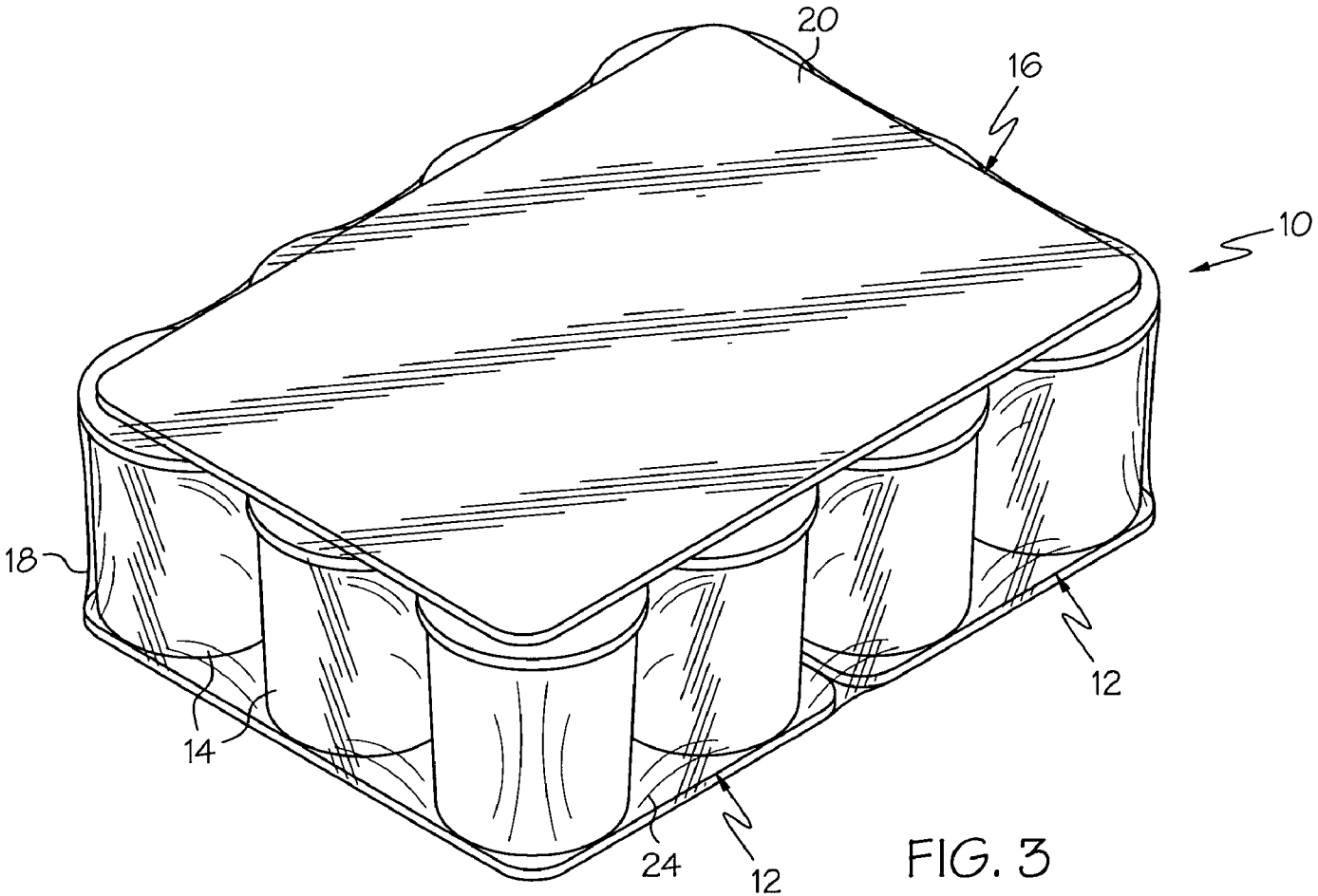
FIG. 3 is a perspective view of an embodiment of the invention.

The trays for use in the inventive package container assembly also may comprise fewer than three side walls. As shown in FIG. 3, the tray does not include any side walls. In accordance with the invention, the tray may also be provided with two side walls or a single side wall. The inclusion of walls 26 on the trays 12, may improve the stability of the package 10, by confining the containers 14 within the confines of the tray 12. The use of walls 26 may help retain the containers 14 on the trays 12 even when the film 18 is removed.

A four-walled tray such as is shown in FIG. 4 may also be used. However, if a tray 12 is equipped with four walls 26, the front wall or lip 30 of the tray 12 is desirably less than the height of the label 32 of the container 14 to ensure proper viewing and ease of access of the containers 14 in a retail display setting.

As may be seen in FIG. 5, the container package assembly 10 may include more than one level or layer of trays 12. In the embodiment shown in FIG. 5, four trays 12 of containers 14 are arranged in two levels: a top level 40 and a bottom level 42. The bottom level 42 comprises two trays 12 of containers 14 arranged horizontally adjacent to one another in the side-by-side fashion previously described. The top level 40 comprises two more trays 12 of containers 14. The trays 12 of the top level 40 are placed directly on top of the containers 14 of the bottom level 42. Optionally, a top pad may be inserted between the containers 14 of the bottom level 42 and the trays 12 of the top lever 40.

As shown, a top pad 16 is placed on top of the containers 14 of the top level 40. The entire assembly of trays 12, containers 14 and top pad 16 is encapsulated in a film 18. The film 18 may include one or more openings 22.

In the embodiment shown in FIG. 5 the top pad 16 is shown having a horizontal surface 20 which has an area less than the area of the support surface 24 of the trays 12 of the top level 40. In some embodiments, the horizontal surface 20 of the top pad 16 may have an area larger or smaller than that of the combined support surfaces 24 of a level of trays 12. In some embodiments, such as the embodiment shown in FIG. 1, the surface 20 may have an area about the same as or less than surface 24 of the combined trays 12. Desirably, the top pad has an area of at least 75% of the combined area of the trays immediately below the top pad.

The various embodiments shown in FIGS. 1-5, may be configured to accommodate containers 14 of various sizes and shapes. For example, the trays 12 may be sized to hold six containers of 6 and/or 8 oz yogurt cups. Six and eight ounce yogurt cups are traditionally shipped in 12 pack shipping packages, or larger. However, at the store level a twelve-count display may be too large to serve as a shelf-ready display. In the embodiments shown in FIGS. 1-4, the package 10 may be used as a twelve-count shipping package which includes two six-count display trays 12 once the film 18 and top pad 16 are removed. In FIG. 5 the package 10 may be used as a twenty four-count shipping package which includes four six-count display trays 12.

The sizes, shapes, numbers, and arrangement of the containers 14 illustrated in FIGS. 1-5 are shown merely as examples of the types of containers which may be packaged, shipped and displayed by the package assembly described herein. For instance, it may be desirable to configure the trays to hold between 2 and 50 containers each. Furthermore, each tray may be configured to hold equal or unequal numbers of columns and/or rows of containers. The columns and/or rows of containers may have equal or unequal numbers of containers therein. It may be further desirable to provide the containers which have a cylindrical, cubic, or some other geometric shape. Additionally, the containers may be larger in area at the bottom than at the top, or larger in area at the bottom than at the top or of constant area along the length of the container.

The invention is also directed to a method for packaging a plurality of containers comprising the steps of providing a plurality of support members including a first support member and a second support member adjacent the first support member, the first and second support members having a plurality of containers disposed thereon, placing a top pad on top of the containers, the top pad extending over at least a portion of each of the containers and at least partially encapsulating the support members, the containers and the top pad with a film. Typically, the support members will have three sidewalls and an open side. More generally, any of the support members disclosed herein may be used in the inventive method.

Figure 6:
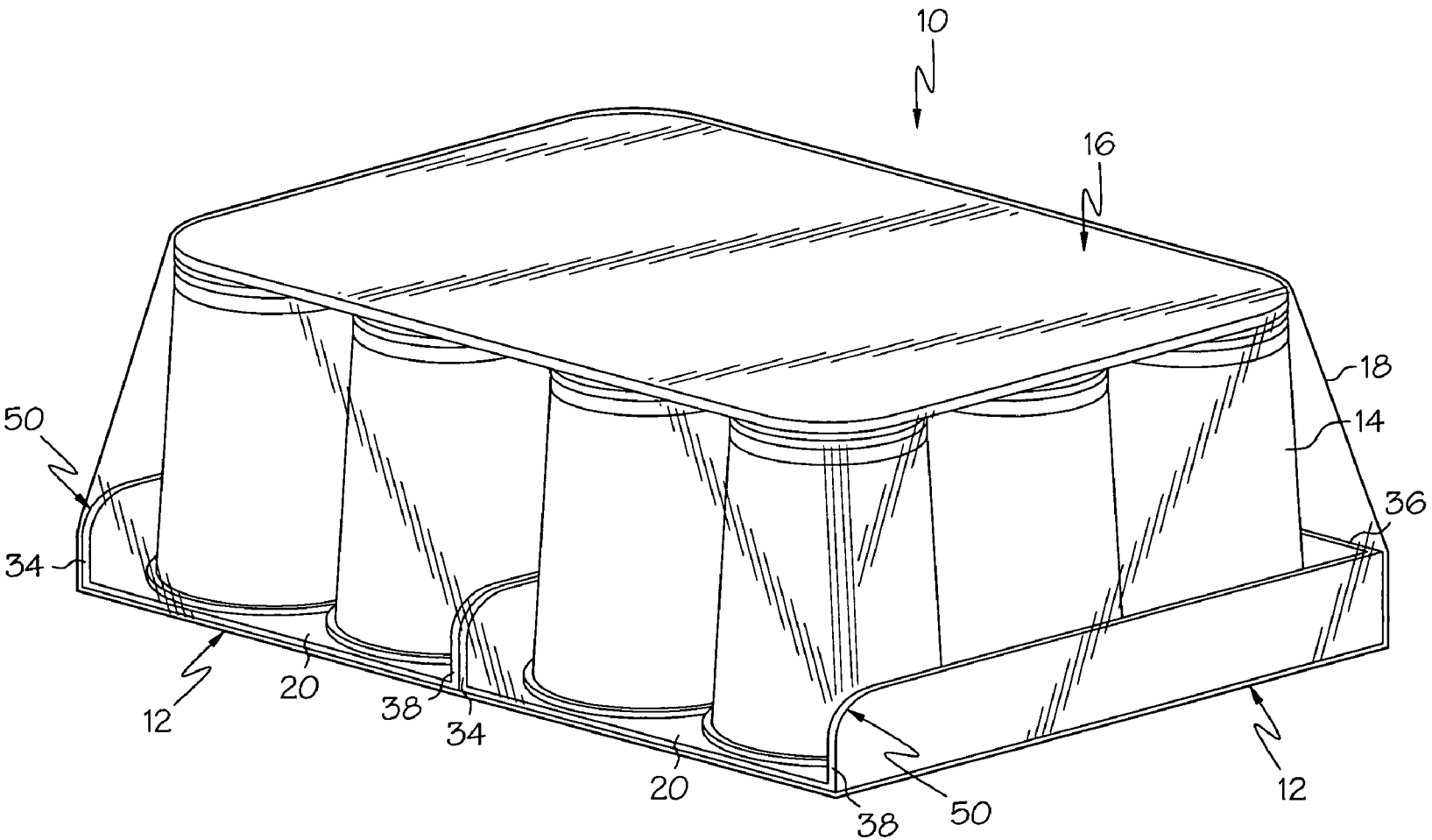
FIG. 6 is a perspective view of an embodiment of the invention wherein the height of a portion of some support member walls defines an arcuate taper.

As previously described each support member or tray 12 may comprise side walls that taper from a first height to a second height. For example in the embodiment shown in FIG. 1 each support member 12 is provided with a right side wall 34 and a left side wall 38 which tapers from a first height near the back 27 of the tray 12 to a second lower height near the front 29 the tray 12. The extent and style of the taper may vary greatly. For example in the embodiment shown in FIG. 6 each support member 12 is provided with a right side wall 34 and a left side wall 38 wherein most of the length of the wall has a substantially constant wall height extending from a back or rear wall 36 toward the front 29 of the tray 12, but a portion of each wall 34 and 38 defines a substantially arcuate or curved taper 50 from a first height to a second lower height as is shown.

Figure 7:
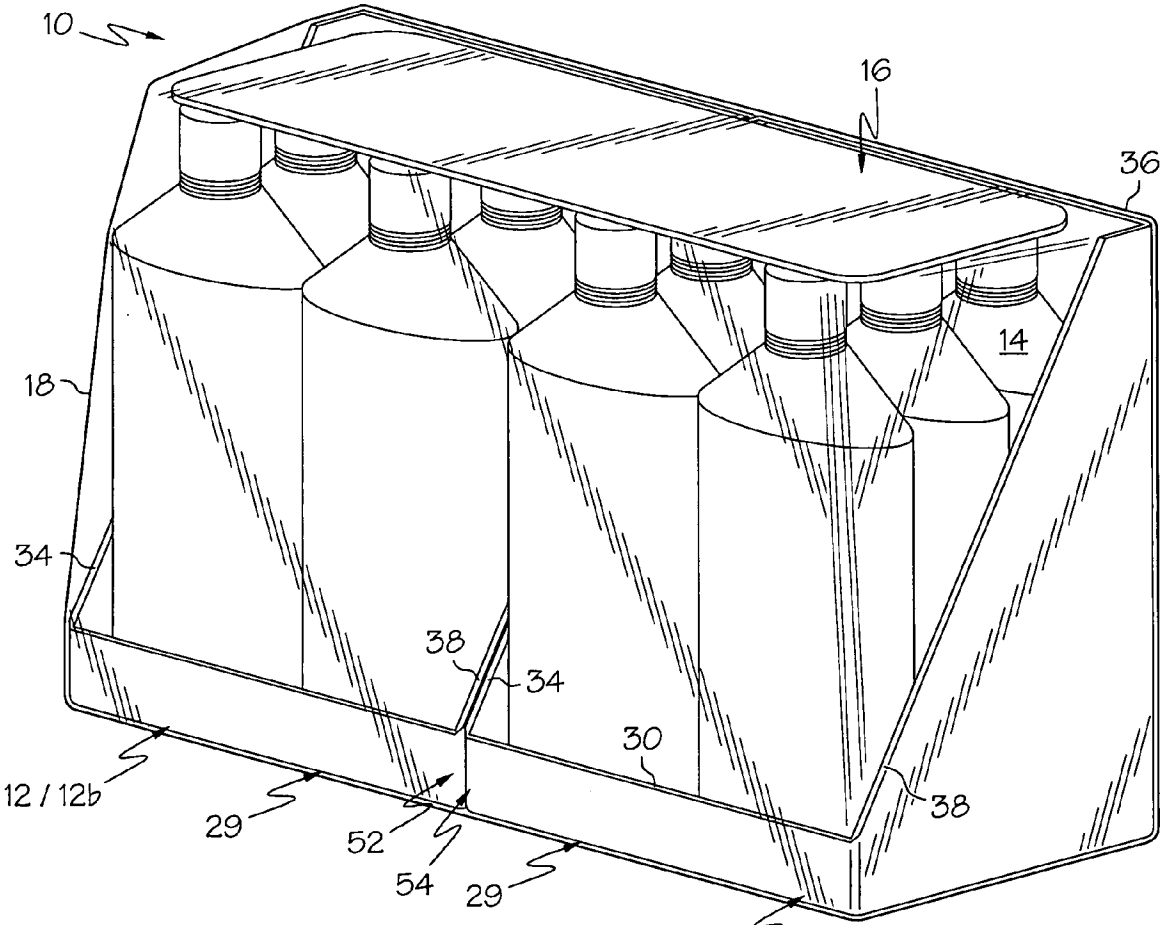
FIG. 7 is a perspective view of an embodiment of the invention wherein a portion of the side walls of the support members are shown having a tapered height and the left side of the first support member is adjacent to the right side of the second support member.
Figure 8:
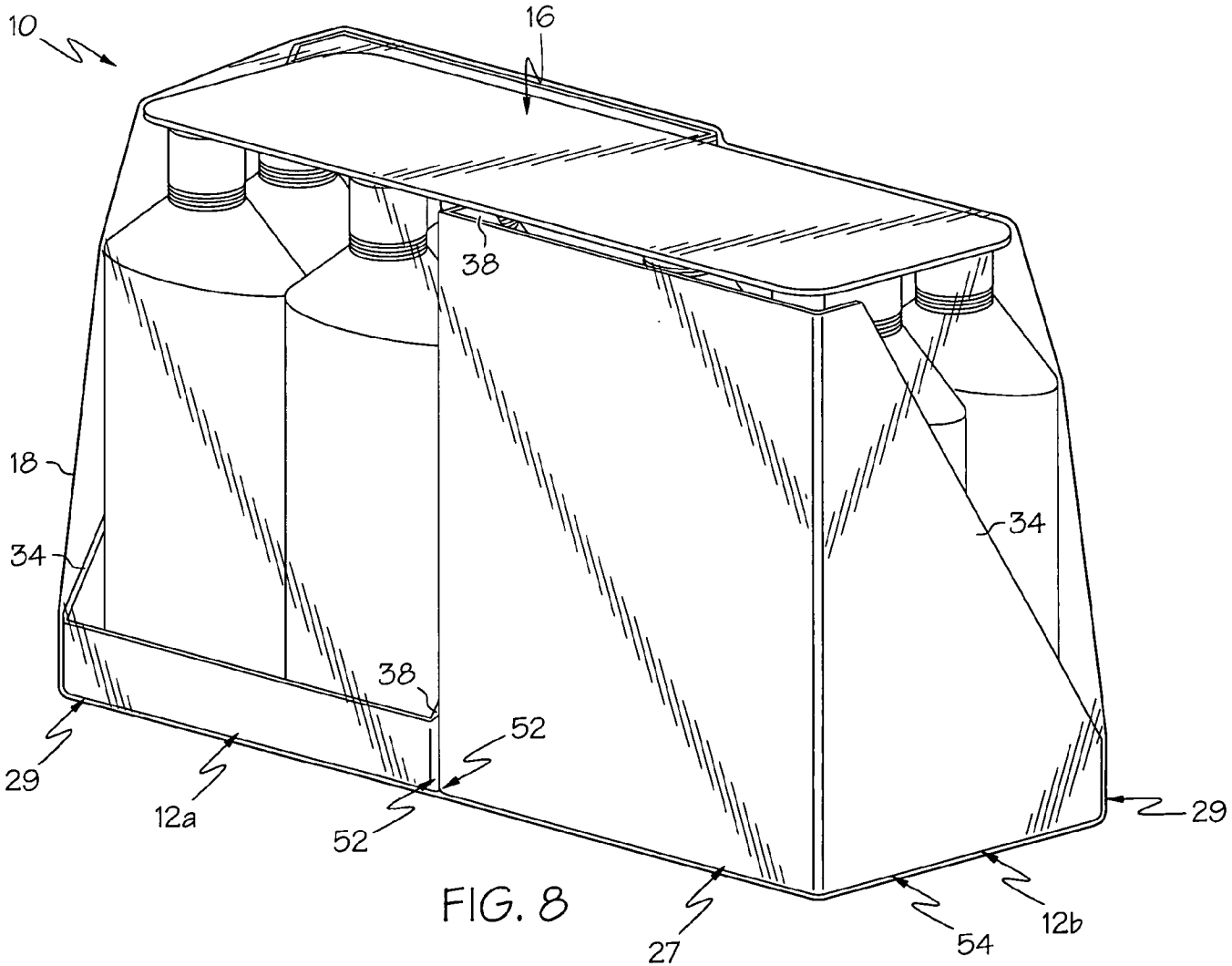
FIG. 8 is a perspective view of an embodiment of the assembly wherein the left side of the first support member is adjacent to the left side of the second support member.

In some embodiments, an example of which is shown in FIG. 7, each support member 12 is provided with a front wall 30 and a back wall 36. A portion of one or more side walls 34 and 38 have a substantially constant height which may be the same as one or both front and back walls 30 and 36. In FIG. 7 the back wall 36 has a height greater than that of the front wall 30. The side walls 34 and 38 taper from the height of the back wall 36 to the height of the front wall 30. The particular configuration of side wall height tapering shown in FIG. 7, provides structural support to the assembly 10 and also leaves enough of the containers 14 exposed to allow a viewer to readily ascertain the quantity of containers 14 that are positioned on the support members 12 from a wide range of viewing angles.

Because the assembly 10 may include a number of support members 12, in some embodiments, examples of which are shown in FIGS. 7-12 each support member 12 may be designated as a specific type of support member, such as a first or right support member 12*a* and a second or left support member 12*b* so as to better describe their relative orientation and position within the assembly 10. For example, in the embodiment shown in FIG. 7 the assembly 10 is provided with a right support member 12*a* and a left support member 12 wherein the left side 52 of the right support member 12 is immediately adjacent to the right side 54 of the left support member 12*b*. As a result of this relative orientation, the front side 29 of each support member 12*a* and 12*b* faces the same direction within the assembly 10.

The assembly 10 however, may be provided with any orientation or configuration of the support members 12*a* and 12*b* relative to one another. For example in the embodiment shown in FIG. 8, the left side 52 of the right support member 12*a* is immediately adjacent to the left side 52 of the left support member 12*b*. As a result of this orientation the front side 29 of each support member 12*a* and 12*b* face opposite directions. In other words the back side 27 of support member 12*b* and the front side 29 of support member 12*a* are arranged along a common plane. The particular configuration shown in FIG. 8 may be particularly useful for displaying products adjacent to or at an isle end display to allow some of the containers to be viewable from either side of the product row.

Figure 9:
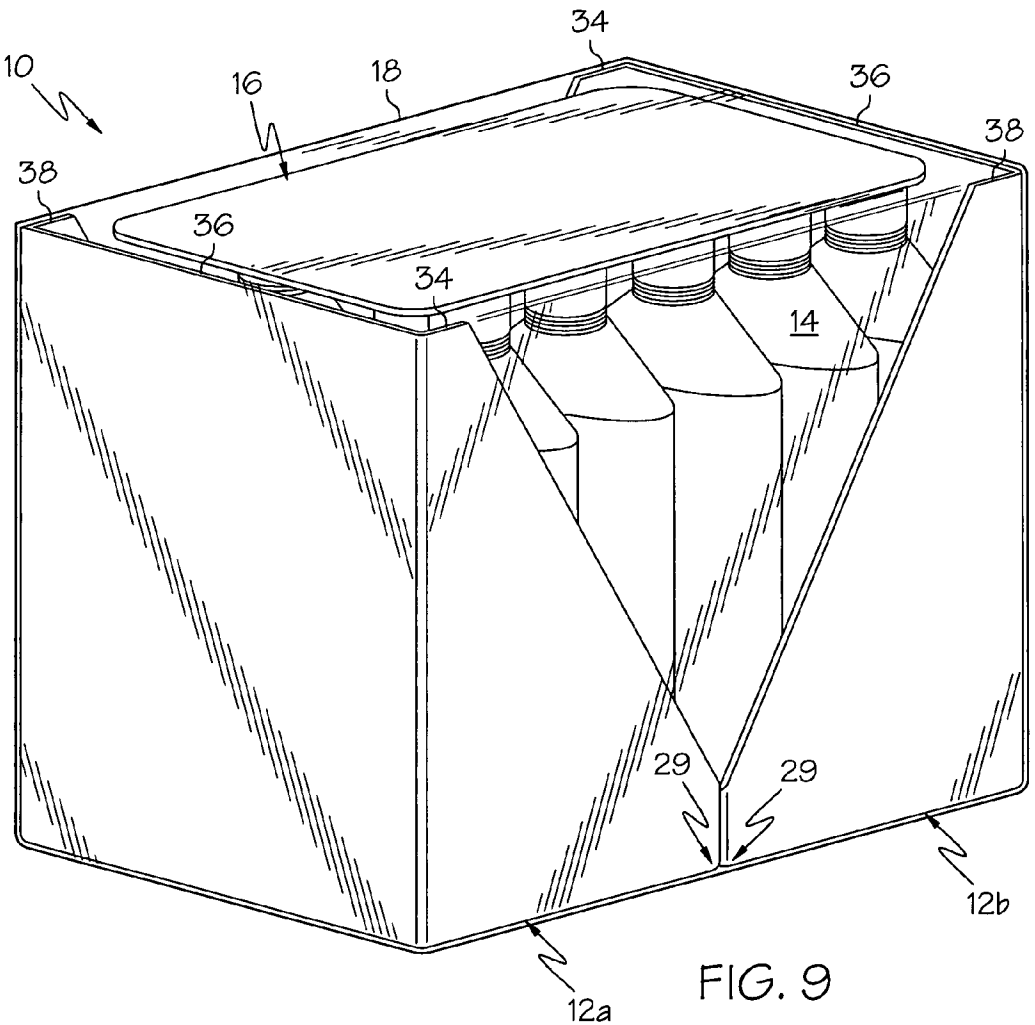
FIG. 9 is a perspective view of an embodiment of the invention wherein the front side of the first support member is adjacent to the front side of the second support member.

In another configuration, such as is shown in FIG. 9 the assembly 10 is provided with support members 12*a* and 12*b* that are arranged so that the front side 29 of each support member is immediately adjacent one another. This particular orientation of support members 12*a* and 12*b* provides additional protection to the containers 14 by at least partially covering the containers 14 with back wall 36 and side walls 34 and 38.

Figure 10:
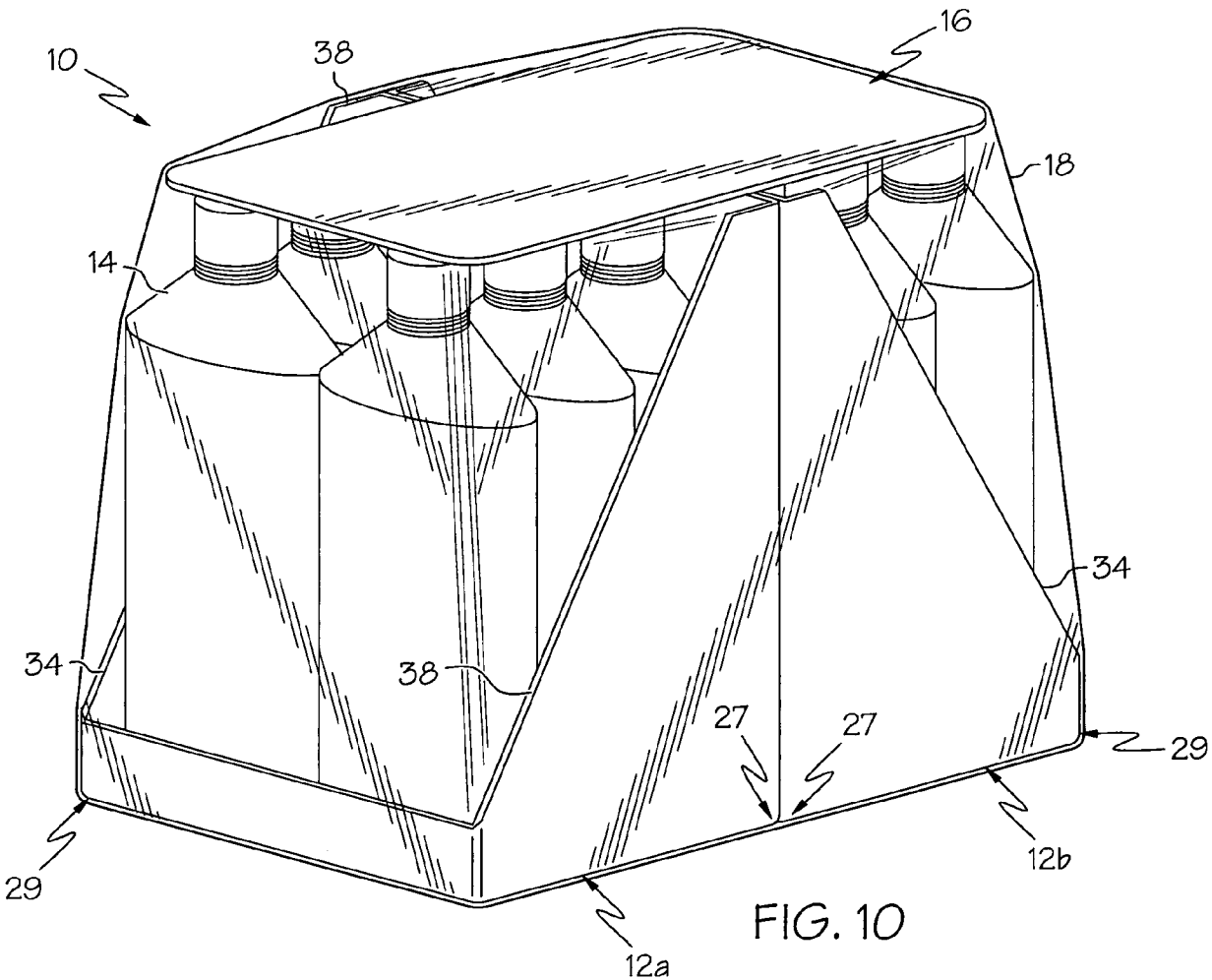
FIG. 10 is a perspective view of an embodiment of the invention wherein the back side of the first support member is adjacent to the back side of the second support member.

Alternatively, the assembly 10 may be configured such that the back side 27 of each support member 12*a* and 12*b* is immediately adjacent one another, such as in the manner shown in FIG. 10.

Figure 11:
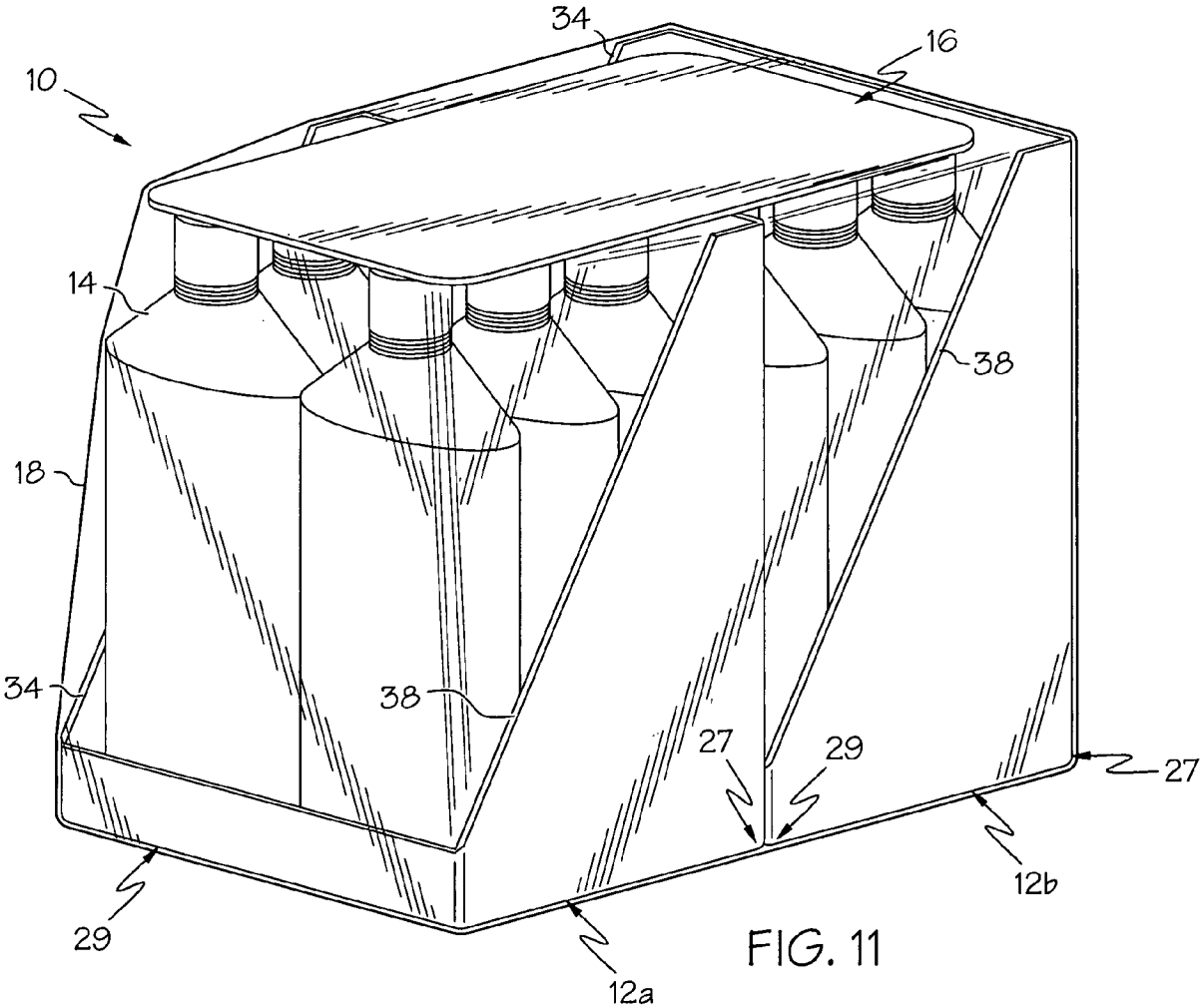
FIG. 11 is a perspective view of an embodiment of the invention wherein the front side of the first support member is adjacent to the back side of the second support member.

In yet another configuration, such as is shown in FIG. 11, the support members 12*a* and 12*b* are arranged with the back side 27 of support member 12*a* immediately adjacent to the front side 29 of the support member 12*b*. This configuration when the containers 14 of the first tray 12*a* are removed, the containers 14 of the second tray 12*b* are made readily available merely by removing the now empty first tray 12*a*.

In the various embodiments shown in FIGS. 7-11, the sides of the support members 12*a* and 12*b* that are immediately adjacent one another may be permanently or temporarily engaged to one another by any of a variety of adhesive materials, such as removable adhesives, time release adhesives, biodegradable adhesives, etc.

Figure 12:
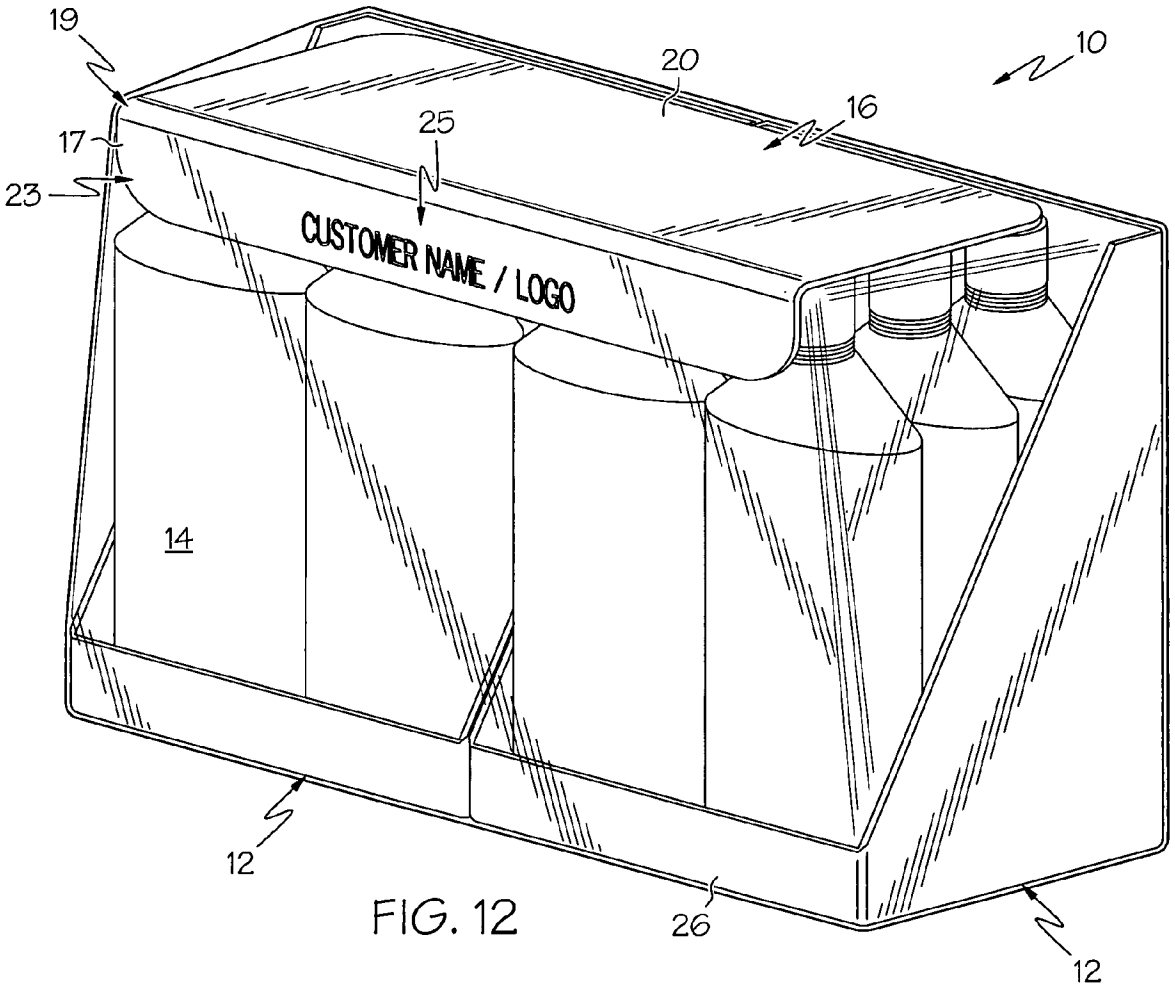
FIG. 12 is a perspective view of an embodiment of the invention wherein the top pad comprises a top pad wall having an advertising surface.

In some embodiments of the invention, an example of which is shown in FIG. 12, the top pad 16 may comprise one or more top pad walls 17. The top pad wall is an extension or portion of the top pad 16 which rather than resting upon the containers 14, is folded away from the horizontal surface 20 of the top pad 16 at an angle. In at least one embodiment, a top pad wall is oriented in a substantially perpendicular manner relative to the horizontal surface 20. In at least one embodiment, such as is shown in FIG. 13, the top pad 16 is manufactured with a seam 19 about which the top pad wall 17 may be folded in a downward direction away from the horizontal surface 20, such as is shown in FIG. 14.

When the top pad wall equipped top pad 16 is placed upon the containers 14 during the construction of the assembly 10, the top pad wall 17 preferably extends to a predetermined downward height toward a support member wall 26 along the same plane as the top pad wall 17. Like the walls of the support members 12, the top pad wall 17 may be of a wide range of constant and/or tapering heights. Similarly, any number of the four sides of the top pad 16, may be further defined by a top pad wall 17. For example, In FIGS. 12-14 the top pad 16 has a single side which is at least partially defined by the top pad wall 17, whereas in the embodiment shown in FIGS. 15-16 two side of the top pad 16 are at least partially defined by a top pad wall 17.

Figure 13:
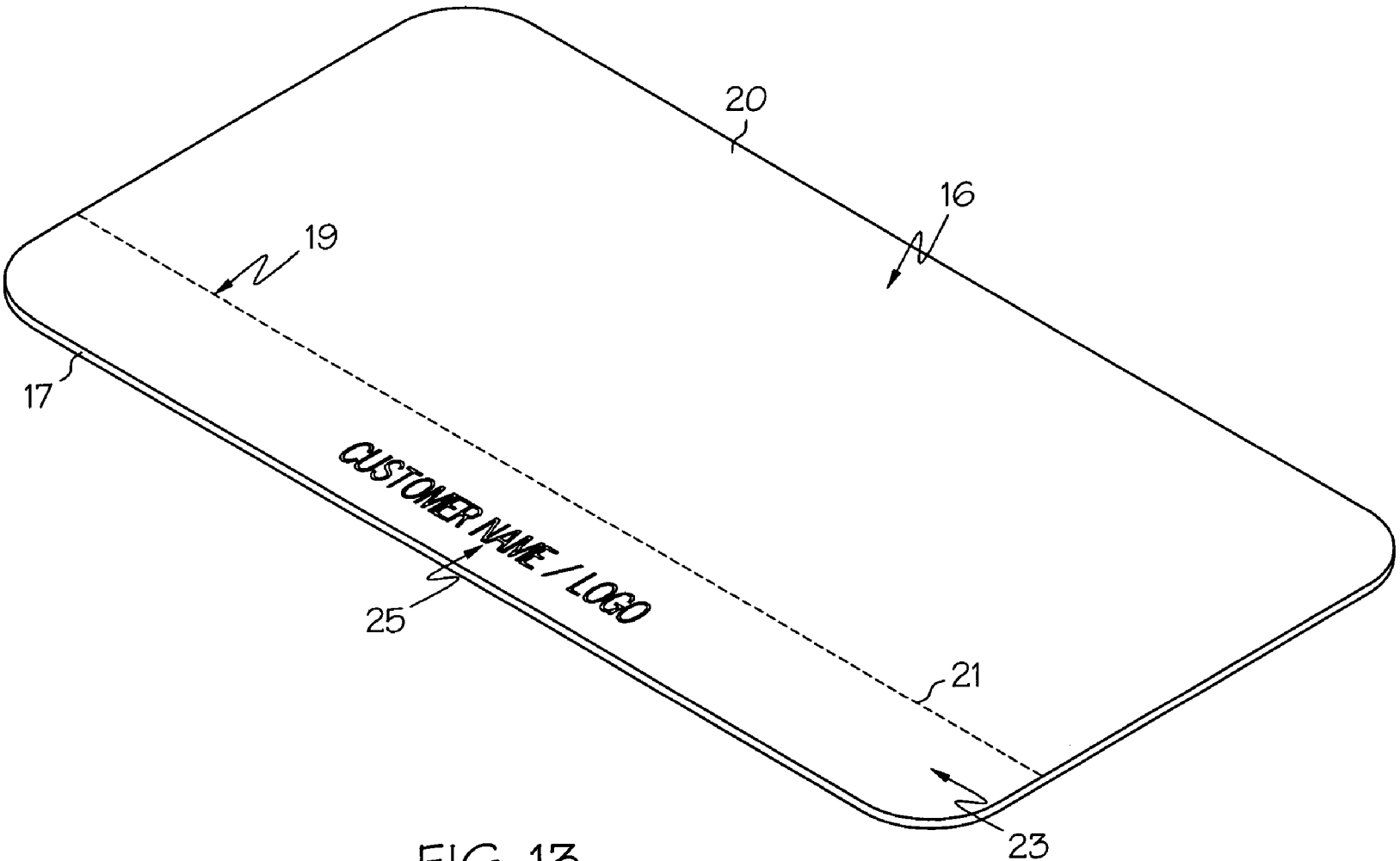
FIG. 13 is a perspective view of the top pad shown in FIG. 12.
Figure 14:
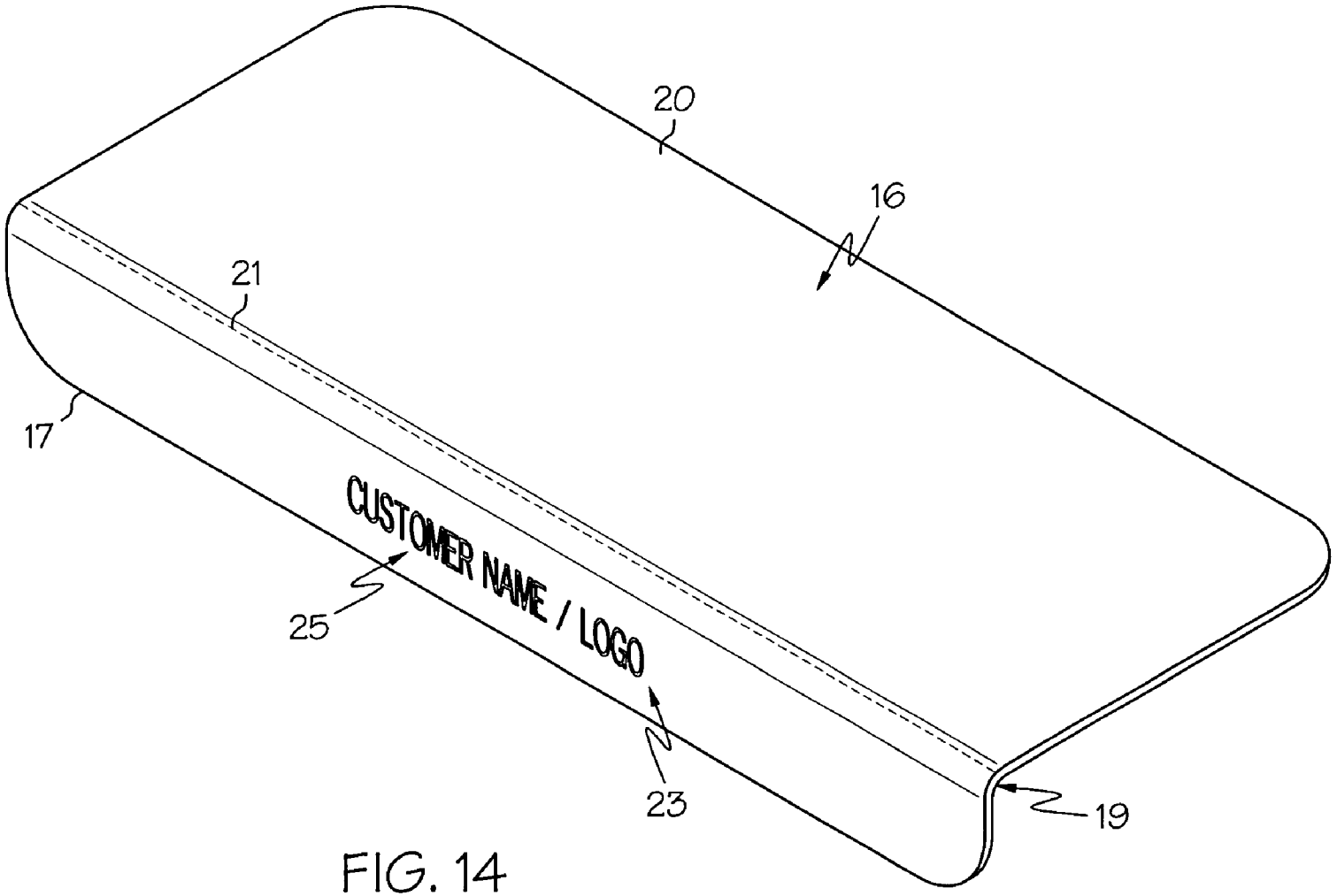
FIG. 14 is a perspective view of the top pad shown in FIG. 12 wherein the top pad wall is provided by folding a portion of the top pad at an angle.
Figure 15:
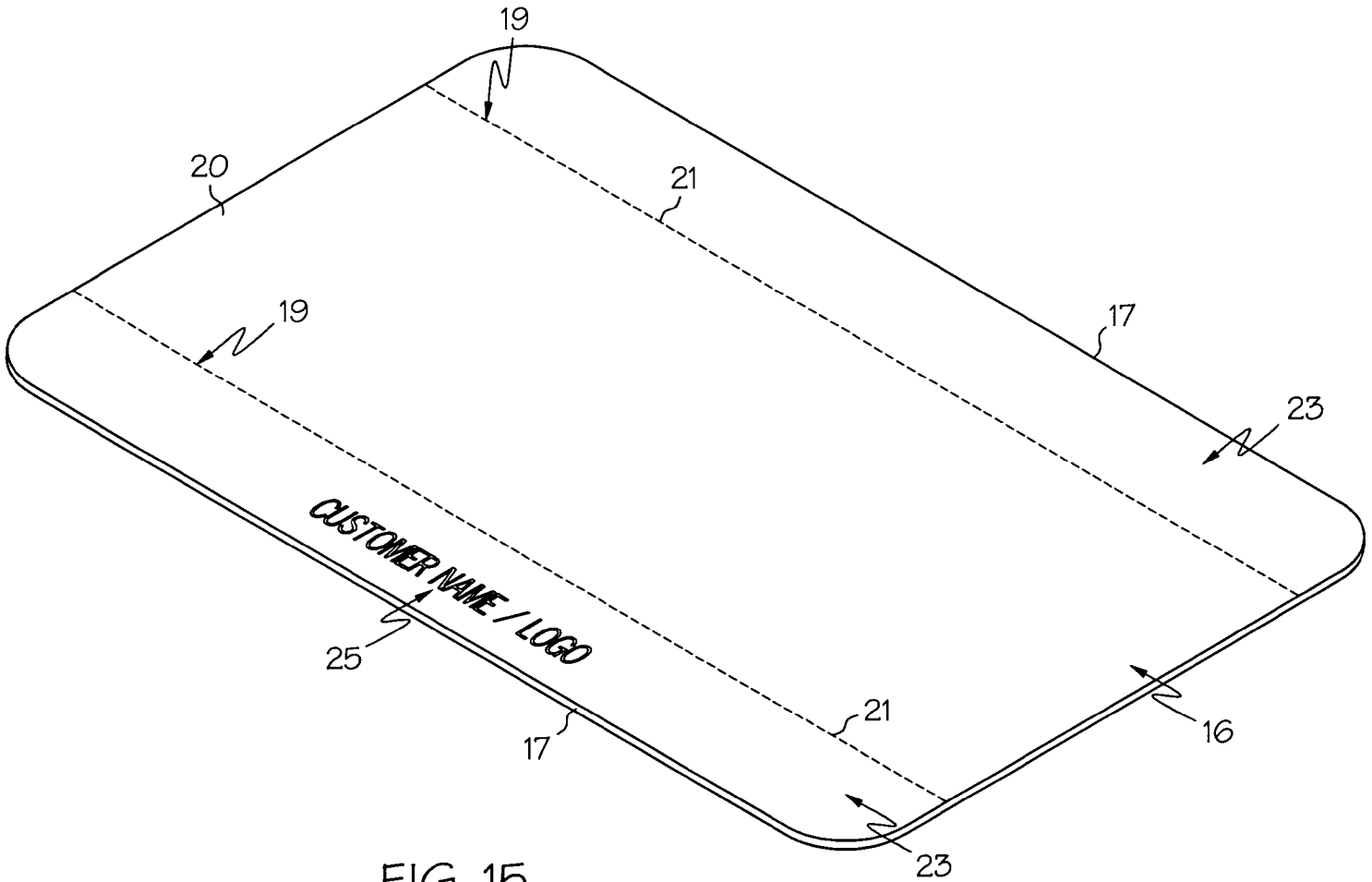
FIG. 15 is a perspective view of a top pad having more than one top pad wall, but prior to formation of the walls.
Figure 16:
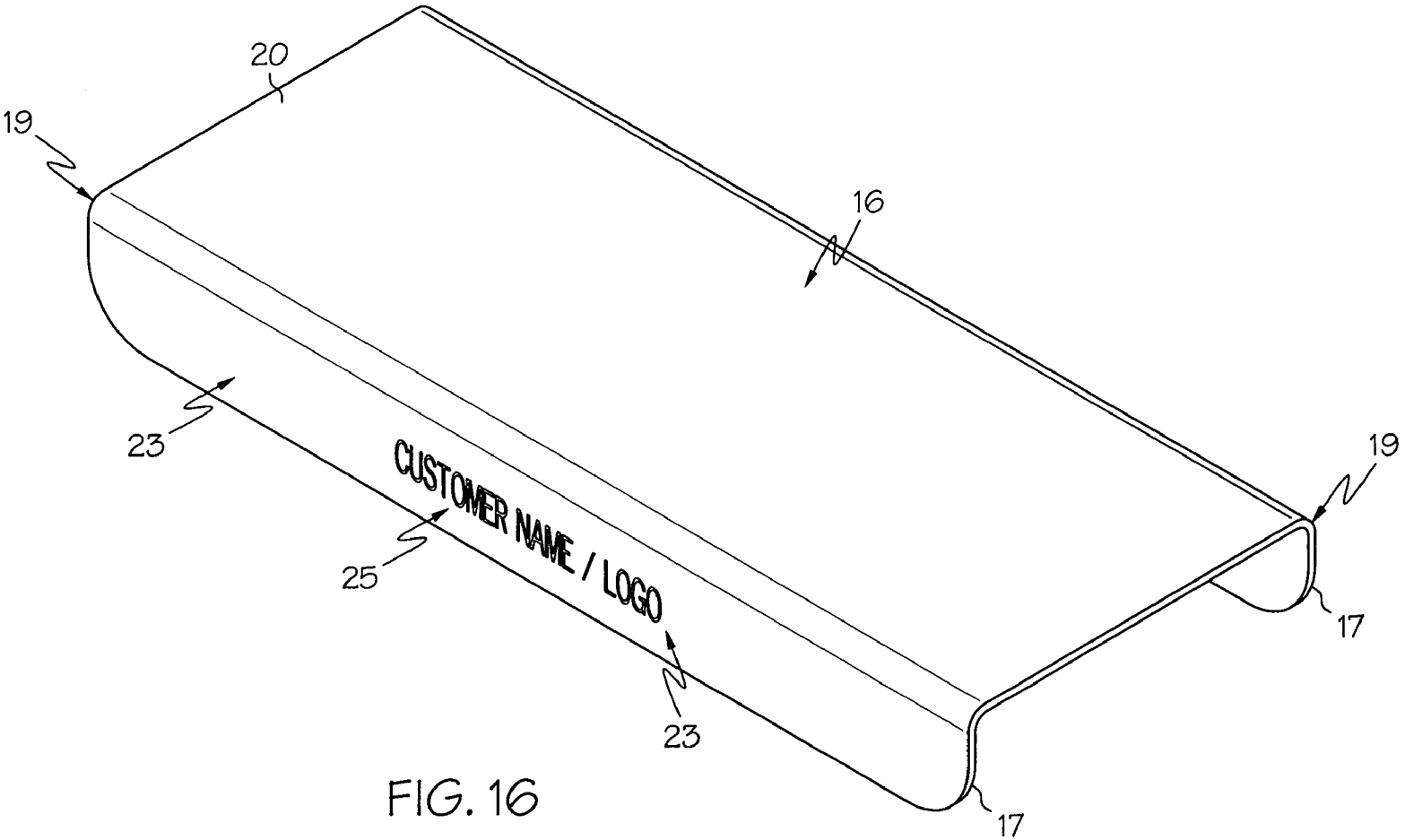
FIG. 16 is a perspective view of the top pad shown in FIG. 15 wherein the walls are formed by folding each wall away from the top pad at an angle.

In some embodiments, such as those shown in FIGS. 13-15 the top pad 16 may define a plurality of perforations 21 through the seam 19. The perforations 21 weaken the engagement of the top pad wall 17 to the top pad 16, which allows the top pad wall 17 to be readily folded away from the top pad 16 and provides a mechanism by which the top pad wall 17 may be readily separated from the top pad 16 if desired.

As is clearly shown in the embodiments depicted in FIGS. 12-16, the top pad wall 17 has a height and length which is preferably spacious enough to provide an indicia bearing surface, or advertising space 23 that is may contain indicia 25 such as brand name, product logo, description and/or other product information, which is readily viewable from a distance appropriate to a retail setting. Though a top pad 16 may include a plurality of top pad walls 17, any of the walls, all of the walls, and/or none of the walls may have indicia 25 placed thereon as desired.

In the various embodiments depicted herein, the assembly may be provided with any of a variety of containers, which may be varied in size, shape, number, and arrangement. Similarly, the support members, including the walls thereof and the top pad may likewise be provided in a variety of shapes and sizes.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

The invention claimed is:

1. A container package assembly comprising:

a first support member and a second support member, each of the first support member and second support member having a front side, a back side, a right side and a left side, the first support member and the second support member being arranged along a common plane wherein one of the sides of the first support member is held immediately adjacent to one of the sides of the second support member by at least one adhesive, the first support member further comprises at least one wall, the at least one wall having a wall Length and a wall height, the at least one wall being substantially perpendicular to a support surface of the first support member, the at least one wall defining at least a portion of at least one of the front side, back side, right side and left side of the first support member, the second support member further comprises at least one wall, the at least one wall having a wall length and a wall height, the at least one wall being substantially perpendicular to a support surface of the second support member, the at least one wall defining at least a portion of at least one of the front side, back side, right side and left side of the second support member, the support surface of the first support member and the support surface of the second support member defining a total support area;

a plurality of containers, the plurality of containers positioned on the support surface of the first support member and the second support member;

a top pad, the top pad positioned on top of the containers, the top pad extending over at least a portion of each of the containers, the top pad having a pad surface oriented substantially parallel to the support surface of the first support member, the pad surface having an area that is less than the total support area; and a film:

the support members, the plurality of containers and the top pad comprising an assembly, the assembly at least partially encapsulated by the film.

2. The assembly of claim 1 wherein the wall height of at least a portion of the at least one wall of the first support member and second support member tapers from a first height to a second height, wherein the second height is less than the first height.

3. The assembly of claim 2 wherein the wall height of the at least a portion of the at least one wall of the first support member and the second support member defines a substantially arcuate taper from the first height to the second height.

4. The assembly of claim 2 wherein the wall height of the at least a portion of the at least one wall of the first support member and the second support member defines a substantially linear taper from the first height to the second height.

5. The assembly of claim 1 wherein the right side of the first support member is immediately adjacent to the left side of the second support member.

6. The assembly of claim 1 wherein the right side of the first support member is immediately adjacent to the right side of the second support member.

7. The assembly of claim 1 wherein the front side of the first support member is immediately adjacent to the front side of the second support member.

8. The assembly of claim 1 wherein the front side of the first support member is immediately adjacent to the back side of the second support member.

9. The assembly of claim 1 wherein the back side of the first support member is immediately adjacent to the back side of the second support member.

10. The assembly of claim 1 wherein the right side of the first support member comprises a right wall and the left side of the first support member comprises a left wall.

11. The assembly of claim 10 wherein the wall height of at least a portion of the right wall and the left wall tapers from a first height to a second height, wherein the second height is less than the first height.

12. The assembly of claim 10 wherein the front side of the first support member comprises a front wall.

13. The assembly of claim 11 wherein the front side of the first support member comprises a front wall, the wall height of the front wall being less than about the first height.

14. The assembly of claim 13 wherein the wall height of the front wall is less than about the second height.

15. The assembly of claim 10 wherein the back side of the first support member comprises a back wall.

16. The assembly of claim 13 wherein the back side of the first support member comprises a back wall, the wall height of the back wall being at least as high as the wall height of the front wall.

17. The assembly of claim 10 wherein the right side of the second support member comprises a right wall and the left side of the second support member comprises a left wall.

18. The assembly of claim 17 wherein the wall height of at least a portion of the right wall and the left wall of the second support member tapers from a first height to a second height, wherein the second height is less than the first height.

19. The assembly of claim 17 wherein the front side of the second support member comprises a front wall.

20. The assembly of claim 18 wherein the front side of the second support member comprises a front wall, the wall height of the front wall being less that about the first height.

21. The assembly of claim 20 wherein the wall height of the front wall of the second support member is less than about the second height.

22. The assembly of claim 17 wherein the back side of the second support member comprises a back wall.

23. The assembly of claim 19 wherein the back side of the second support member comprises a back wall, the wall height of the back wall of the second support member being at least as high as the wall height of the front wall of the second support member.

24. A container package assembly comprising:

a first support member and a second support member, each of the first support member and second support member having a front side, a back side, a right side and a left side, the first support member and the second support member being an arranged along a common plane wherein one of the sides of the first support member is immediately adjacent to one of the sides of the second support member, the first support member further comprises at least one wall, the at least one wall having a wall length and a wall height, the at least one wall being substantially perpendicular to a support surface of the first support member, the at least one wall defining at least a portion of at least one of the front side, back side, right side and left side of the first support member, the wall height of the front side being less than the wall height of the back side;

the second support member further comprises at least one wall, the at least one wall having a wall length and a wall height, the at least one wall being substantially perpendicular to a support surface of the second support member, the at least one wall defining at least a portion of at least one of the front side, back side, right side and left side of the second support member, the wall height of the front side being less than the wall height of the back side;

a plurality of containers, the plurality of containers positioned on the support surface of the first support member and the second support member;

a top pad, the top pad positioned on top of the containers, the top pad extending over at least a portion of each of the containers; and a film;

the support members, the plurality of containers and the top pad comprising an assembly, the assembly at least partially encapsulated by the film;

wherein the front side of the at least one wall of the first support member is immediately adjacent to the front side of the at least one wall of the second support member, the assembly further comprising at least one adhesive, the at least one adhesive adhesively engaging the at least one wall of the first support member to the at least one wall of the second support member.

25. The assembly of claim 24 wherein the at least one adhesive is a temporary adhesive or a permanent adhesive.

* * * * *